US005550721A

United States Patent [19]

Rapisarda

[11] Patent Number: 5,550,721

[45] Date of Patent: Aug. 27, 1996

[54] MOTION SENSITIVE LIGHT AND BATTERY ASSEMBLY SWITCHED ON AND OFF BY THE OSCILLATION OF A HELICAL SPRING

[75] Inventor: Thomas C. Rapisarda, Pico Rivera, Calif.

[73] Assignee: Carmen & Thomas Rapisarda Enterprises, Monrovia, Calif.

[21] Appl. No.: 437,617

[22] Filed: May 8, 1995

[51] Int. Cl.[6] ..... F21L 11/00

[52] U.S. Cl. ..... 362/205; 362/276; 362/394; 362/800; 362/802; 200/61.48

[58] Field of Search ..... 362/205, 276, 362/394, 800, 802; 200/61.45 R, 61.48, 61.49, 61.51

[56] References Cited

U.S. PATENT DOCUMENTS

| | | | |
|---|---|---|---|
| 3,731,022 | 5/1973 | Loftus | 200/61.48 |
| 4,800,469 | 1/1989 | Leon | 362/205 |
| 4,995,294 | 2/1991 | Kashio et al. | 200/61.48 |
| 5,058,900 | 10/1991 | Denen | 362/802 |
| 5,400,232 | 3/1995 | Wong | 362/800 |

*Primary Examiner*—Denise L. Gromada
*Assistant Examiner*—Alfred Basichas
*Attorney, Agent, or Firm*—Edgar W. Averill, Jr.

[57] ABSTRACT

A light emitting diode having a helical spring around one of its leads. The spring extends so that it has a free end which is cantilevered. As the free end of the spring moves it completes an electrical circuit intermittently lighting the light emitting diode.

10 Claims, 3 Drawing Sheets

Fig. 5
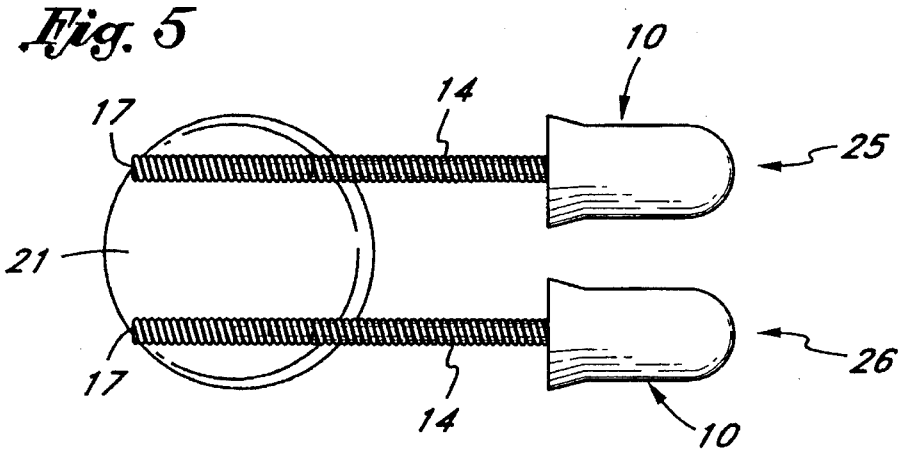
Fig. 6
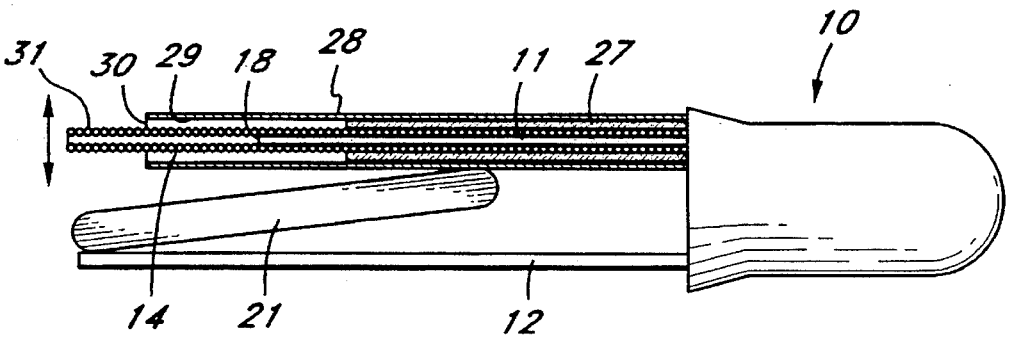
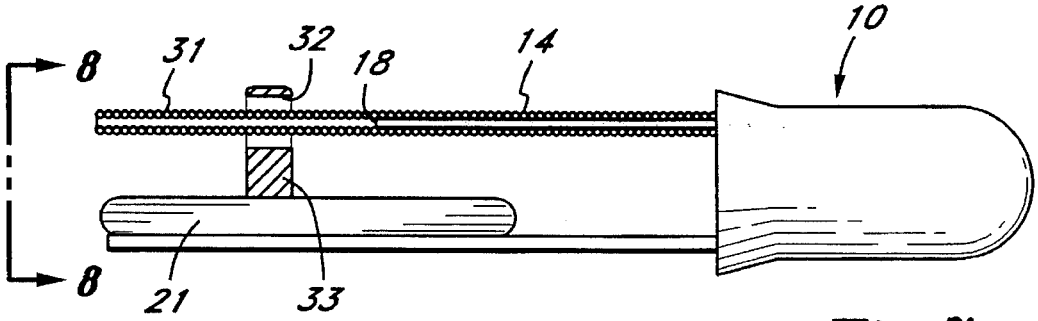
Fig. 7
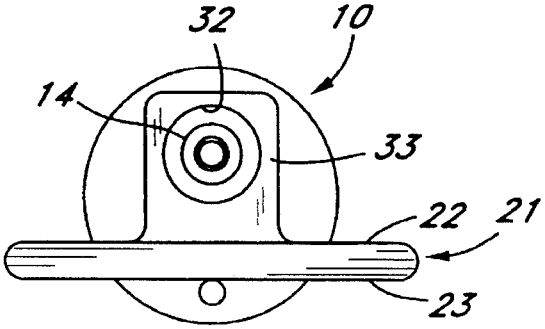
Fig. 8

MOTION SENSITIVE LIGHT AND BATTERY ASSEMBLY SWITCHED ON AND OFF BY THE OSCILLATION OF A HELICAL SPRING

BACKGROUND OF THE INVENTION

The field of the invention is lighting and the invention relates more particularly to an assembly which provides intermittent light when moved.

Springs have been used in conjunction with switches and one such device is shown in U.S. Pat. No. 3,731,022 which utilizes a weighted helical spring positioned within a conductive opening for the purpose of sensing shocks and vibrations.

U.S. Pat. No. 4,271,451 has an ornamental article which utilizes a link chain which intermittently completes an electrical circuit.

Another vibration sensor is shown in U.S. Pat. No. 4,679,033 which supports a conductive cone on a helical spring. The interior of the conductive cone surrounds an adjustable contact point and as the cone moves, the circuit is completed.

U.S. Pat. No. 4,995,294 shows a percussion instrument including a striker which utilizes a switch comprising a coiled spring surrounding a conductor. When the striker is hit against a solid object the inertia of a portion of the spring completes the circuit to close a switch and energize the electronic percussion instrument.

With the durability and light weight of light emitting diodes it has become possible to construct small light weight assemblies which can be placed in toys, sporting goods, ornamental objects and the like and yet a durable and reliable method of turning the light on and off with very slight movement has yet to be commercialized.

SUMMARY OF THE INVENTION

It is an object of the present invention to provide a highly sensitive switch assembly which is reliable and capable of operation with very slight movement.

The present invention is for an assembly for providing intermittent light with movement. The assembly has a light source with electrical conductors including a straight electrical lead having a remote end. An insulator surrounds a part of the straight lead leaving a bare part uninsulated adjacent the remote end. A flexible conductive helical spring having an inside diameter and an inside surface is held by the insulator over the straight and extends past the remote end of the straight lead a distance of at least two times the inside diameter of the helical spring. A battery has one terminal connected to the second conductor of the light source and the first terminal connected to the spring. The spring by its own weight extending past the remote end of the straight lead will oscillate with very slight movement of the assembly, thereby completing the circuit and turning the light emitting diode on and off in a remarkable and sustained manner.

BRIEF DESCRIPTION OF THE DRAWINGS

FIG. 5 is a plan view of an alternate embodiment of the assembly of FIG. 1.

FIG. 6 is a side view partly in cross-section of an alternate embodiment of the assembly of FIG. 1.

FIG. 7 is a side view partly in cross-section of an alternate embodiment of a movement sensitive switch of the present invention.

FIG. 8 is a view taken along line 8—8 of FIG. 7.

DESCRIPTION OF THE PREFERRED EMBODIMENTS

Figure 1:
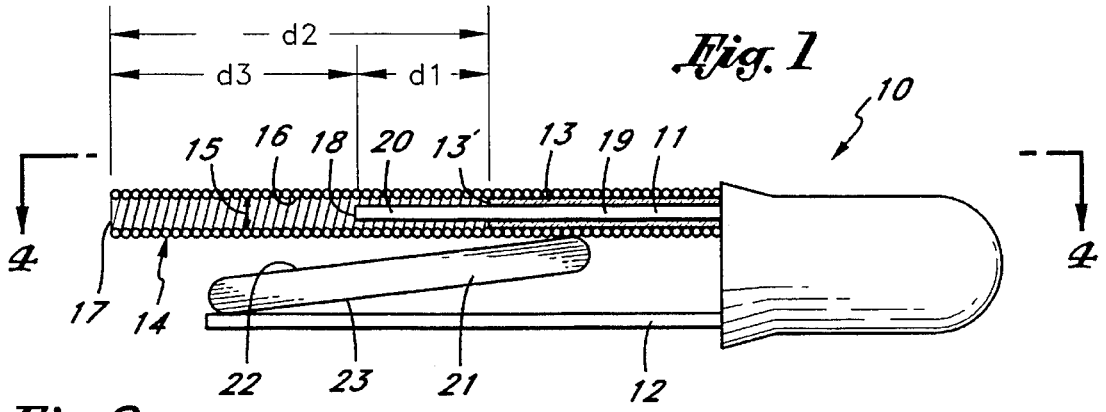
FIG. 1 is a side view partly in cross-section of the assembly for providing sustained, intermittent light with movement of the present invention.

A light emitting diode is shown in side view in FIG. 1 and indicated generally by reference character 10. Light emitting diode 10 has a first conductor 11 and a second conductor 12. First conductor 11 is surrounded by an insulator 13. Insulator 13 has a remote end 13' and insulator 13 supports a flexible conductive helical spring 14. Spring 14 is cantilevered past the remote end 13' of insulator 13. Spring 14 has an inside diameter 15 and an inside surface 16. Spring 14 also has a free end 17 which extends substantially past the remote end 18 of first conductor 11. Remote end 18 functions as an exposed end terminal of conductor 11. First conductor 11 has an insulated part 19 and a bare part 20.

A battery 21 has an upper terminal 22 and a lower terminal 23. Upper terminal 22 is in electrical contact with spring 14 and lower terminal 23 is in electrical contact with second conductor 12.

Figure 2:
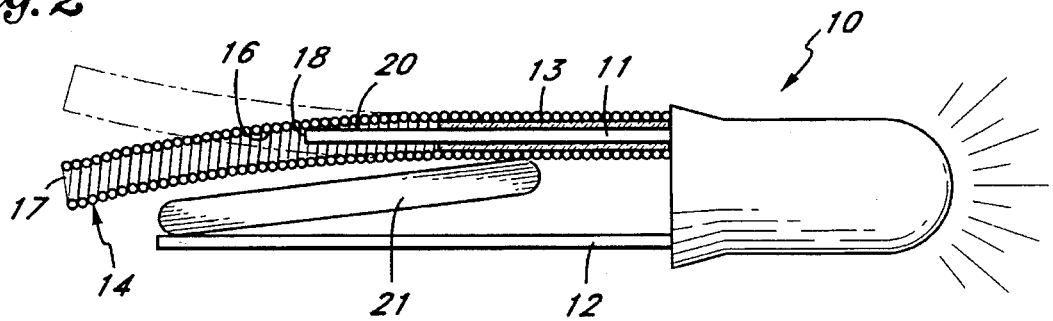
FIG. 2 is a side view partly in cross-section analogous to FIG. 1 except that the helical spring is shown in a downwardly flexed position.
Figure 3:
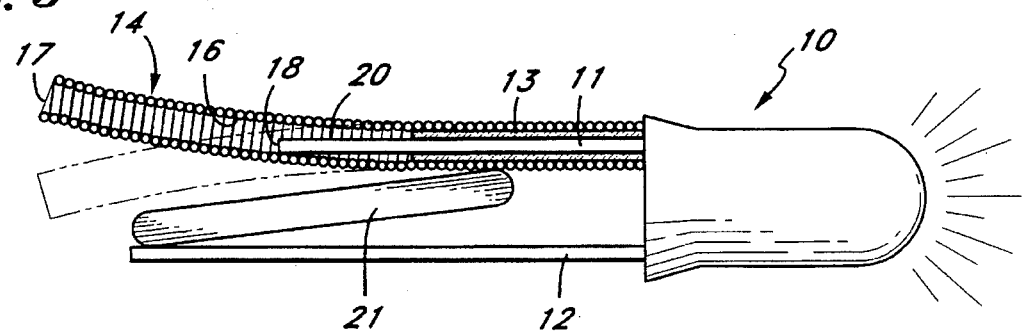
FIG. 3 is a side view partly in cross-section analogous to FIG. 1 except that the helical spring is shown in an upwardly flexed position.
Figure 4:
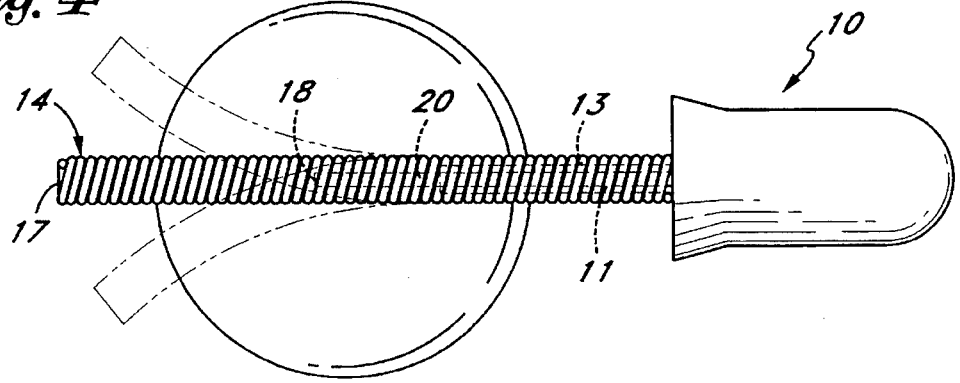
FIG. 4 is a plan view taken along line 4—4 of FIG. 1.

An essential feature of the present invention is the extent to which spring 14 extends past the remote end 18 of first conductor 11. By extending past the remote end at least two times the inside diameter 15 of the spring, a substantial amount of inertia is present so that even a small movement of the assembly will cause the free end of the spring 17 to move upwardly, downwardly or sideways (as shown in FIG. 4) so that the inside surface 16 contacts the remote end 18 of first conductor 11 causing the assembly to light as shown in FIGS. 2 and 3. As stated above, spring 14 is supported in a cantilevered manner by insulator 13 and more specifically from the remote end 13' thereof. As shown in FIG. 1, the assembly is at rest and the inside surface 16 does not contact first conductor 11 and thus, the LED does not light. If the assembly is moved upwardly as viewed in FIG. 2, the free end 17 of spring 14 will move downwardly from its cantilevered point at remote end 13'. As it continues to move downwardly, the inside surface 16 will contact the exposed end terminal 18 of first conductor 11 completing an electrical circuit and lighting LED 10. As the flexible spring continues to move it will now be deflected from contact with exposed end terminal 18 until its flexibility will cause it to reverse direction. As it reverses direction, it passes through the position shown in FIG. 1 turning off the LED and continues to the position shown in phantom view in FIG. 2 where it once again lights the LED by a second contact between the inner surface 16 and exposed end terminal 18. With appropriate choice of spring flexibility and length this intermittent lighting even with no further assembly movement may continue typically for one to five seconds providing a sustained stroboscopic lighting.

Spring 14 can move in any direction. In FIGS. 2 and 3 the spring is shown oscillating up and down. In FIG. 4 the spring is shown oscillating sideways. It can, of course, move in any radius of a circle as viewed along conductor 11.

While the overhang of the spring past the exposed end terminal 18 is essential, there are actually three variables that affect the rate of blinking of the LED as well as the length of time the blinking will be sustained. Of course, the flexibility of the spring is yet another variable, but, with a fixed flexibility, these three lengths determine the nature of the light provided upon movement. The distance between the remote end 13' of insulator 13 and the extended end terminal 18 is indicated by reference character d1 in FIG. 1. The cantilevered length of the spring as it extends past remote end 13' to the free end 17 is indicated by reference character "d2" and the extent to which the spring extends past the exposed end terminal 18 is indicated by reference character "d3". The length of d1 determines the sensitivity of the assembly. The longer d1 is the more sensitive the assembly becomes. The overall cantilevered d2 also affects the sensitivity and length d3 controls the rate and duration of the on and off cycles of the assembly.

With a spring made from 0.008" diameter wire, having an overall length of 1" and an inside diameter of 0.43", a sustained lighting upon one movement will be approximately 3 seconds when the LED lead is ½" and the insulator covers one-half of the LED lead. Thus, referring to the reference characters in FIG. 1, d1 would be ¼" and d2 would be ¾" and d3 would be ½". In this preferred example, the free end of the spring extends a distance of about 12 times the inside diameter past the exposed end terminal. Thus, between two and 24 times the inside diameter is functional, and a preferred multiple would be between six and 18 times with about 12 being ideal. If such an assembly is placed within a toy or other ornamental device which is typically moved during use, the assembly will oscillate on and off almost continuously during use. The term "briefly sustained" is intended to indicate a time period of from about one-half second to about five seconds. Yet, when the assembly is at rest, the light will turn off, thus not unnecessarily draining the battery and not requiring the user to remember to turn off the assembly.

In FIG. 4 a top view of the device is shown with the insulator 13, the bare part 20 of first conductor 11 and the remote end 18 of first conductor 11 shown in phantom view within spring 14.

In FIG. 5 a pair of assemblies 25 and 26 are shown utilizing a single wafer battery 21.

In FIG. 6 spring 14 again extends past remote end 18 of conductor 11. In this version, however, spring 14 is entirely in contact with conductor 11 and an insulator 27 surrounds the exterior of a portion of spring 14. A rigid conductive tube 28 is supported by the insulator and has an inner surface 29 and a remote end 30. During movement, the moveable spring portion 31 which extends past remote end 18 oscillates and contacts the inner surface 29 of conductive tube 28 intermittently completing a circuit.

In FIGS. 7 and 8 moveable spring portion 31 contacts the inner ring 32 of conductive block 33 which is in electrical contact with the upper terminal 22 of battery 21. The second conductor 12 of LED 10 is in electrical contact with the lower terminal 23 of battery 21.

Figure 9:
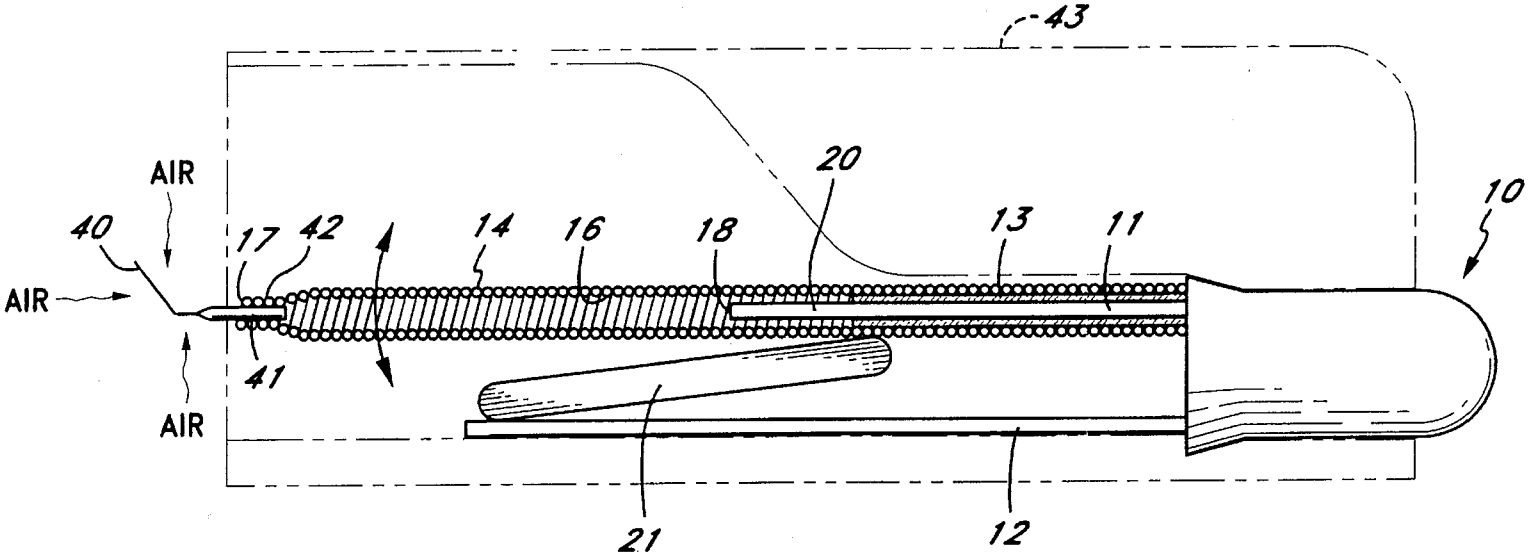
FIG. 9 is a side view partly in cross-section of a wind activated switch.
Figure 10:
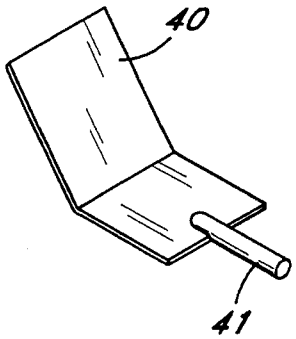
FIG. 10 is an enlarged perspective view of the sail portion of the switch of FIG. 9.

A wind activated switch is shown in FIGS. 9 and 10 where a sail 40 is connected through pin 41. Pin 41 is held by a reduced portion 42 located at the remote end 17 of helical spring 14. The sail 40 is preferably fabricated from a light weight plastic sheet which is relatively rigid. Thus, as the air strikes sail 40 the remote end 17 of helical spring 14 is oscillated, thereby completing a circuit between the inside surface 16 of spring 14 and the remote end 18 of first conductor 11. A housing 43 is shown in phantom view to hold the elements of the assembly and the result is a light weight and highly sensitive wind activated lighting assembly.

The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

I claim:

1. A process for intermittently and briefly sustainedly energizing an electrically powered light comprising:

electrically connecting a straight, conductive lead to a first lead of the electrically powered light having first and second leads;

insulating a portion of said straight, conductive lead to provide an insulated portion and leaving at least an exposed end terminal;

supporting a flexible, helical spring over at least a portion of said insulated portion of said straight, conductive lead, said helical spring having a conductive inner surface, said flexible, helical spring having a central axis;

positioning said flexible, helical spring so that when said spring is at rest it surrounds, overhangs but does not touch said exposed end terminal, the length that said spring overhangs said conductive end terminal being a overhanging length;

abruptly moving said straight, conductive lead in a direction so that the overhanging length exhibits a wagging movement, said wagging movement being sufficient that the conductive inner surface contacts said exposed end terminal and is deflected thereby and caused to move in an opposite direction by contact with said conductive end terminal; and contacting said spring to one lead of a source of electrical energy and contacting another lead of said source of electrical energy to said second lead of said electrically powered light whereby when said conductive inner surface of said spring contacts said exposed end terminal, a circuit is completed in an intermittent and briefly sustained manner.

2. An assembly for providing intermittent and briefly sustained light with movement of the assembly comprising:

a light source having a first and a second conductor for attachment to a source of electromotive force;

a straight lead electrically connected to said first conductor, said straight lead having an exposed end terminal;

an insulator surrounding a part of the length of said straight lead and leaving said exposed end terminal uninsulated and said insulator having a remote end spaced from said exposed end terminal;

a flexible, conductive helical spring having an inside diameter and an inside surface surrounding and in contact with said insulator and said flexible, conductive helical spring extending past said insulator over and past said exposed end terminal so that it surrounds said exposed end terminal and the inside surface is spaced from said exposed end terminal when the spring is at rest, said spring having a fixed end surrounding said insulator and a free end, said free end extending a distance of at least two times the inside diameter past the exposed end terminal and said spring being sufficiently flexible so that the free end will oscillate from the remote end of said insulator until the inside surface of the spring contacts the exposed end terminal and the spring will continue to move being deflected by contact between the exposed end terminal and said inside surface until the spring's flexibility causes it to reverse its movement and move in an opposite direction and cease contact with the exposed end terminal and, as it continues to move, the inside surface of the spring will again contact the exposed end terminal and once again be deflected by contact with the exposed end terminal; and a battery having a pair of terminals, one of said terminals being electrically connected to said second conductor of said light source, and the other of said pair of terminals being connected to said flexible, conductive helical spring, whereby when the free end of said spring is moved, the spring will oscillate and its inside surface come into intermittent and repeated contact with said exposed end terminal of said straight lead thereby completing an electrical circuit and intermittently and sustainedly lighting said light source.

3. The assembly for providing intermittent light with movement of claim 2 wherein said free end extends a distance of between two and twenty four times the inside diameter of the spring.

4. The assembly for providing intermittent light with movement of claim 3 wherein said free end extends a distance of between six and eighteen times the inside diameter of the spring.

5. The assembly for providing intermittent light with movement of claim 3 wherein said free end extends a distance of about twelve times the inside diameter of the spring.

6. The assembly for providing intermittent light with movement of claim 2 wherein the free end of the spring has sail means affixed thereto so that wind will deflect the free end to complete the circuit intermittently.

7. The assembly for providing intermittent light with movement of claim 2 wherein said light source is a light emitting diode having a first and a second conductor extending therefrom and said straight lead is one of said first and second conductors of said light emitting diode.

8. The assembly for providing intermittent light with movement of claim 7 wherein said insulator is a length of spaghetti tubing.

9. The assembly for providing intermittent light with movement of claim 7 wherein said battery is a wafer battery.

10. The assembly for providing intermittent light with movement of claim 9 wherein the wafer battery is positioned between the first and second conductors of said light emitting diode.

* * * * *